US010934718B2

(12) United States Patent
Tucker

(10) Patent No.: US 10,934,718 B2
(45) Date of Patent: Mar. 2, 2021

(54) FAUX RAFTER TAIL

(71) Applicant: Street Smart Buyer, LLC, Holland, MI (US)

(72) Inventor: Phillip Tucker, Holland, MI (US)

(73) Assignee: Street Smart Buyer, LLC, Holland, MI (US)

( * ) Notice: Subject to any disclaimer, the term of this patent is extended or adjusted under 35 U.S.C. 154(b) by 0 days.

(21) Appl. No.: 16/739,373

(22) Filed: Jan. 10, 2020

(65) Prior Publication Data

US 2020/0224426 A1 Jul. 16, 2020

Related U.S. Application Data

(60) Provisional application No. 62/800,695, filed on Feb. 4, 2019, provisional application No. 62/790,860, filed on Jan. 10, 2019.

(51) Int. Cl.
*E04D 13/158* (2006.01)
*E04B 9/00* (2006.01)

(52) U.S. Cl.
CPC ..... *E04D 13/158* (2013.01); *E04B 9/005* (2013.01)

(58) Field of Classification Search
CPC ..... E04D 13/158; Y10S 52/08; E04B 9/005; E04F 19/02
USPC ..... 52/91.1, 92.1, 92.2, 92.3, 93.1, 93.2, 94, 52/96
See application file for complete search history.

(56) References Cited

U.S. PATENT DOCUMENTS

| | | | | |
|---|---|---|---|---|
| 820,641 | A * | 5/1906 | Gleason | 52/100 |
| 4,283,894 | A * | 8/1981 | Raty | E04B 9/005 52/311.1 |
| 4,866,901 | A * | 9/1989 | Sanchez | E04G 23/02 52/514 |
| 6,782,666 | B1 | 8/2004 | Condon et al. | |
| 7,076,923 | B2 * | 7/2006 | Seldon | E04D 13/0722 52/93.2 |
| 7,165,372 | B1 * | 1/2007 | Skulsky | B44C 5/00 256/19 |
| 7,694,488 | B2 * | 4/2010 | Saurey | E04D 13/158 52/745.06 |
| 7,823,336 | B2 | 11/2010 | Brochu et al. | |
| 8,161,709 | B2 | 4/2012 | Saurey et al. | |
| 8,555,560 | B2 | 10/2013 | Rasmussen et al. | |
| 8,984,816 | B2 | 3/2015 | Loughren et al. | |
| 9,719,259 | B2 | 8/2017 | Guzman et al. | |
| 2003/0041531 | A1 * | 3/2003 | Seldon | E04D 13/158 52/94 |
| 2006/0283110 | A1 | 12/2006 | Ferguson | |
| 2007/0204528 | A1 | 9/2007 | Shugart | |

(Continued)

*Primary Examiner* — Brent W Herring
(74) *Attorney, Agent, or Firm* — Oppenhuizen Law PLC; David L. Oppenhuizen

(57) ABSTRACT

A faux rafter tail configured to be securable below a soffit. The faux rafter tail has an elongated structure which includes a middle section, and terminates in a proximal end and a distal end. The faux rafter tail may include a body portion and a top portion. The top portion may include a mounting tab at each of the proximal and distal ends, and each of the mounting tabs extends in a direction away from the middle section of the faux rafter tail with each of the mounting tabs having a lower surface and an upper surface. The faux rafter tail may optionally include an alignment nub or the mounting tab having a measurement or length indicator.

10 Claims, 22 Drawing Sheets

(56) References Cited

U.S. PATENT DOCUMENTS

| | | | | |
|---|---|---|---|---|
| 2010/0107549 | A1* | 5/2010 | Ingram | E04D 13/158<br>52/718.04 |
| 2015/0284952 | A1 | 10/2015 | Hilliaho | |
| 2017/0067259 | A1* | 3/2017 | Guzman | E04F 19/02 |

* cited by examiner

FAUX RAFTER TAIL

CROSS REFERENCE TO RELATED APPLICATIONS

This application claims the benefit of U.S. Provisional Application 62/790,860, which was filed on Jan. 10, 2019, and U.S. Provisional Application 62/800,695, which was filed on Feb. 4, 2019, the disclosures of which are hereby incorporated by reference.

FIELD OF THE PRESENT DISCLOSURE

The present disclosure generally relates to faux architectural components. More particularly, the present disclosure relates to faux rafter tails that are attachable under a soffit without any fasteners or anchoring apparatus.

BACKGROUND

Generally, soffits are part of the cornice or eave, which is the point where the roof projection and the side walls of the building meet. The cornice adds to the appearance of the home, and it also helps to protect the building from sun, rain, and snow. In most instances the cornices or eaves are finished off with a soffit covering on the underside of the overhang. However, older homes often have an open eave, and in that case the end of the rafters, or referred to hereinafter as rafter tails, are exposed. Although rafter tails were exposed in older homes do purely to lack of a soffit, it has become a desirable ornamental architectural feature in newer homes to display exposed rafter tails, even with homes that have a soffit.

Furthermore, the earliest type of soffits that were commonly used were simply sheets of plywood with vented holes. The use of faux rafter tails is also well-known in the art, and faux rafter tails formed from solid pieces of wood or similar material are easily installed or fastened to the plywood soffits using screws, glues, or other similar means.

However, newer soffits are typically extruded sheets of plastic that include holes. These plastic sheets are suspended on opposite ends, with one end being positioned near the side wall of the house, and the other end being positioned near the bottom of the roofline.

The faux rafter tails which are currently available are not suitable for use with the newer plastic sheet soffits because the new soffits lack sufficient structural strength to support the faux rafter tails. Accordingly, there is a need for more efficient and cost friendly rafter tails for precise positioning of the traditional soffit application.

SUMMARY

The invention overcomes the drawbacks in the prior art and provides a rafter tail that is attachable under a soffit without any fasteners or anchoring apparatus in accordance with an example embodiment described herein to secure below a soffit.

In one aspect, there is provided a faux rafter tail to be secured below a soffit, the faux rafter tail being elongated, having a middle section, and terminating in a proximal end and a distal end; the faux rafter tail including a body portion and a top portion, the top portion including a mounting tab at each of the proximal and distal ends, each of the mounting tabs extending in a direction away from the middle section of the faux rafter tail, and each of the mounting tabs having a lower surface and an upper surface.

According to some embodiments, the body portion and the top portion comprise separate pieces which are configured for assembly together with each other.

According to some embodiments, the faux rafter tail comprises two halves that are divided along the elongated length thereof, whereby each half is substantially a mirror image of the other half.

In another aspect, the top portion is a flat planar plate terminating in the mounting tabs at each end thereof, and the top portion is secured atop the body portion.

In some example embodiments, the faux rafter tail has a mounting plate that is configured for securement into a vertical wall surface, and the mounting plate is also configured for attachment to the proximal end of the body portion.

Optionally, the mounting plate may include a lower wall and opposed side walls, with the lower wall and side walls forming a receptacle for receiving the body portion. In some example embodiment, the mounting plate and the body portion include complementary fasteners for secure attachment to one another.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Figure 1A:
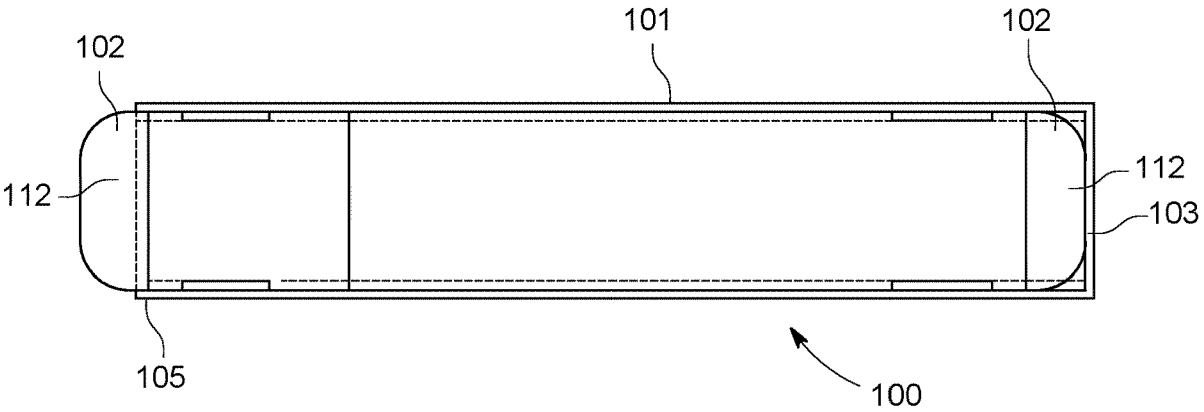
Figure 1B:
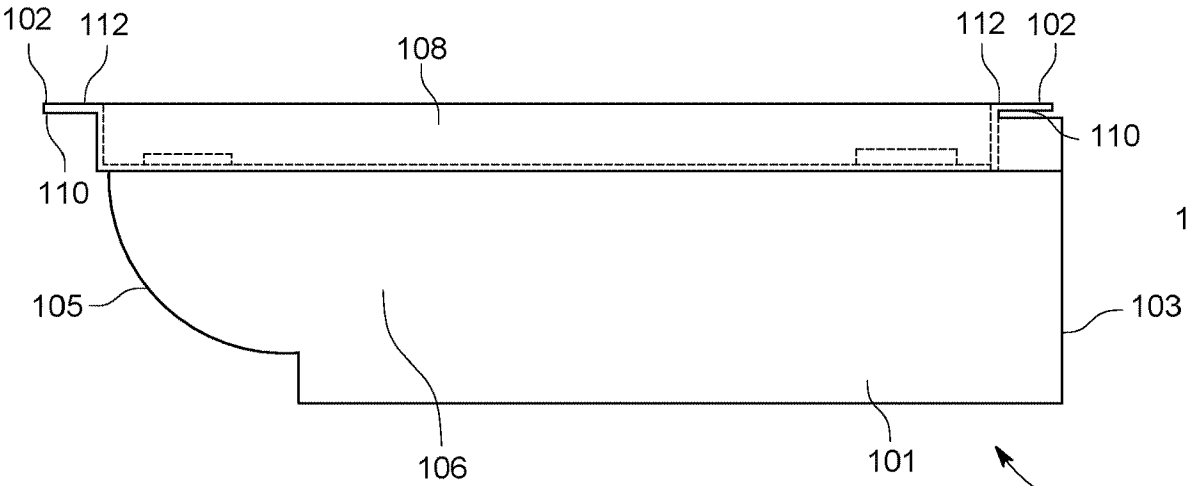
Figure 1C:
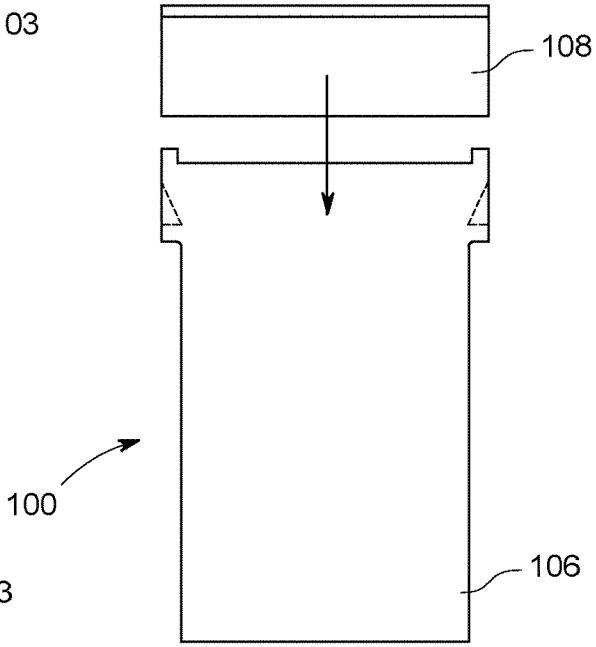
Figure 2A:
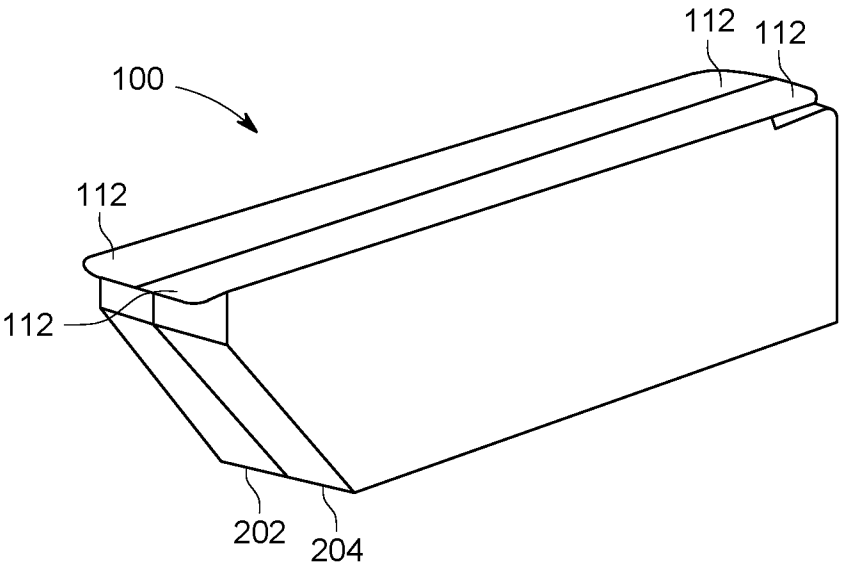
Figure 2B:
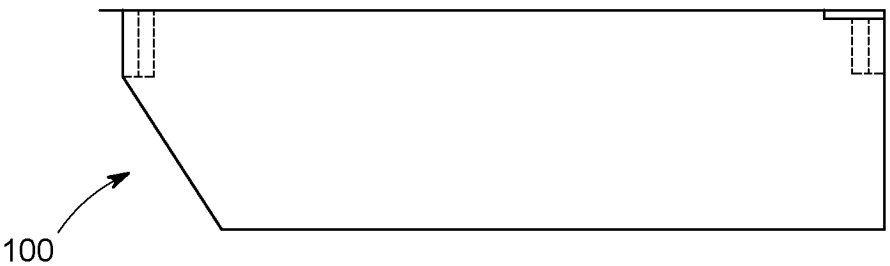
Figure 3:
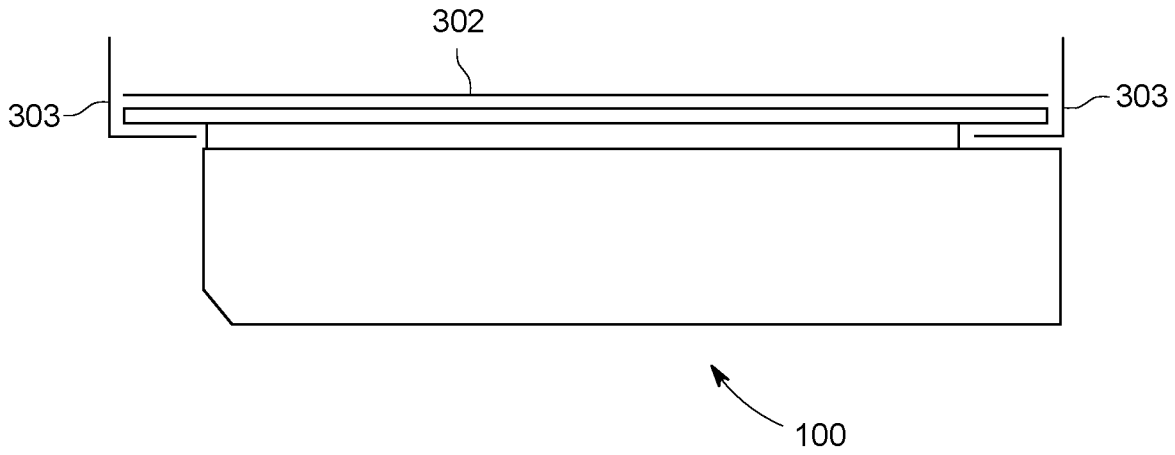
Figure 4:
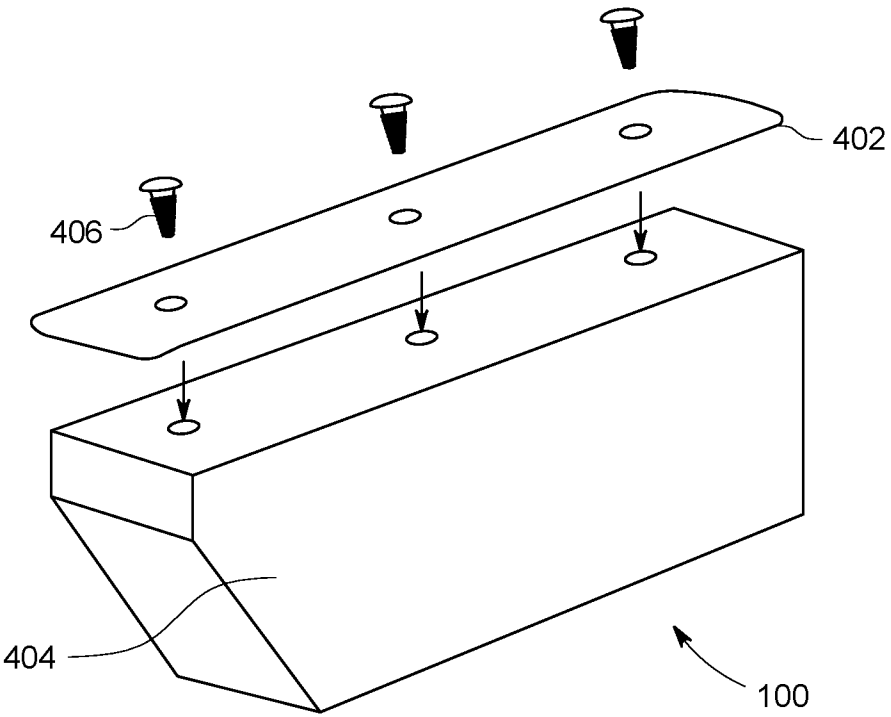
Figure 5:
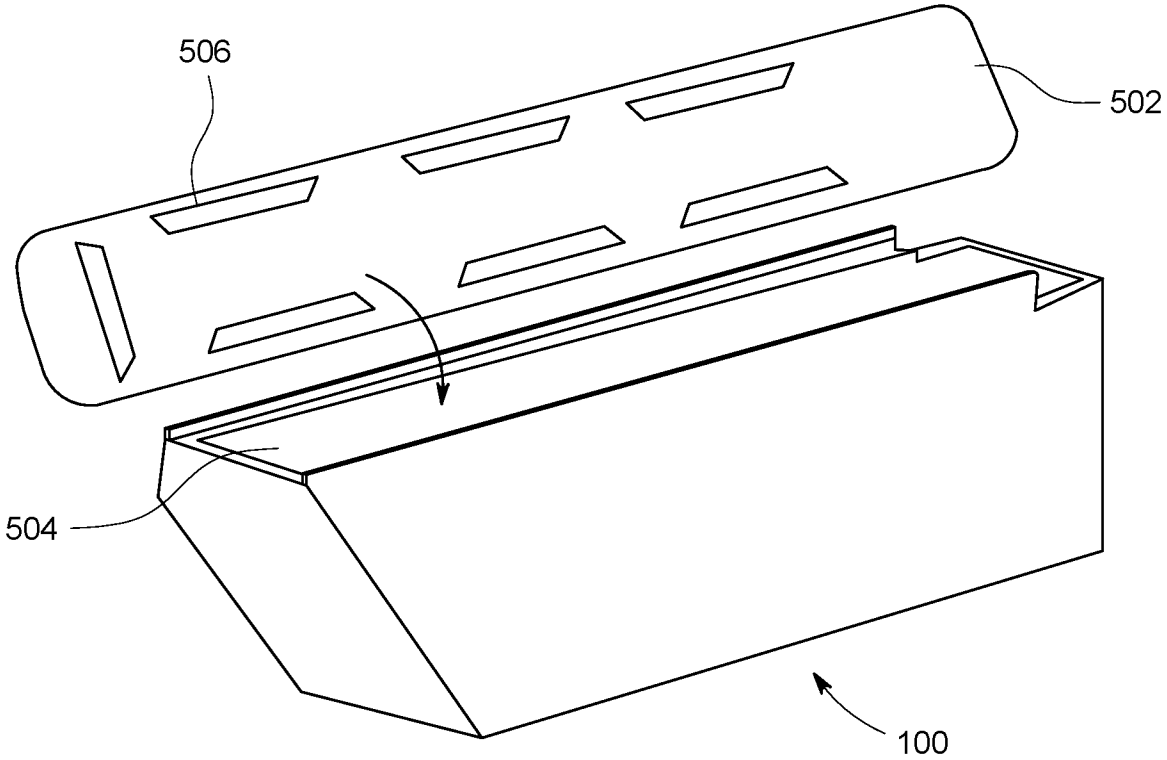
Figure 6:
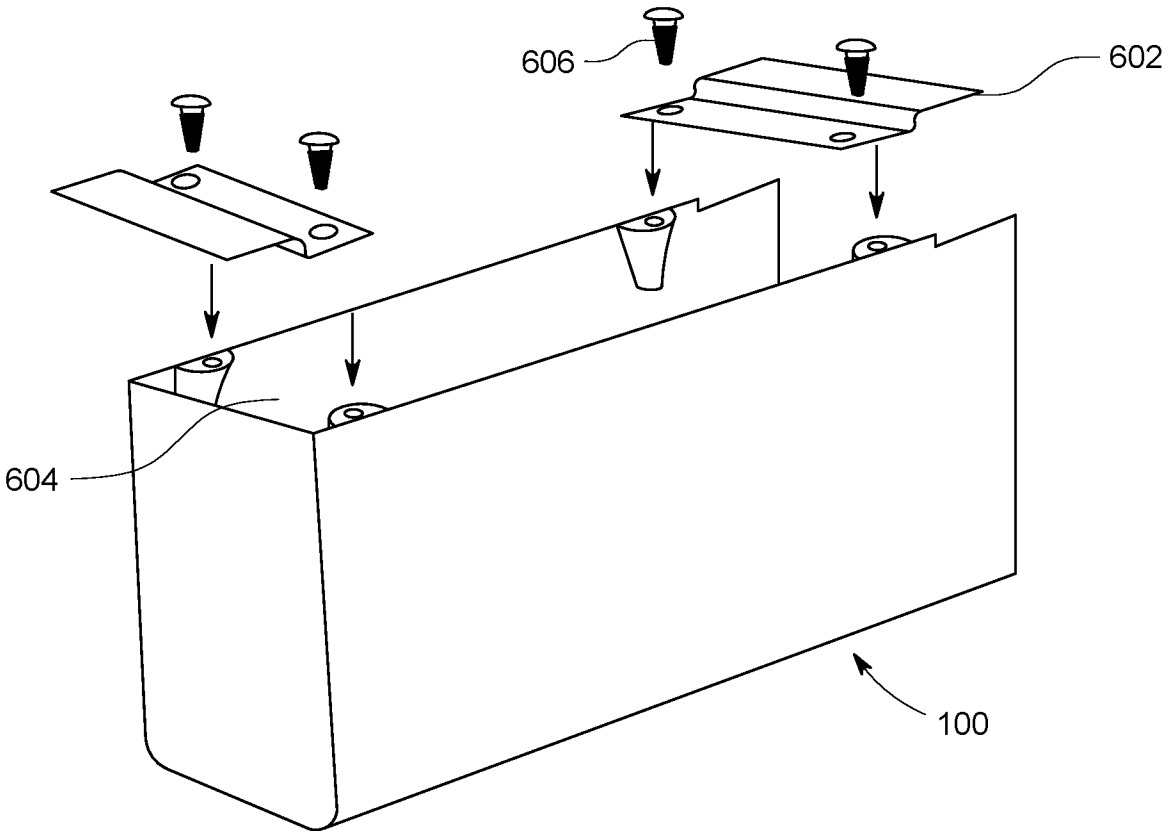
Figure 7:
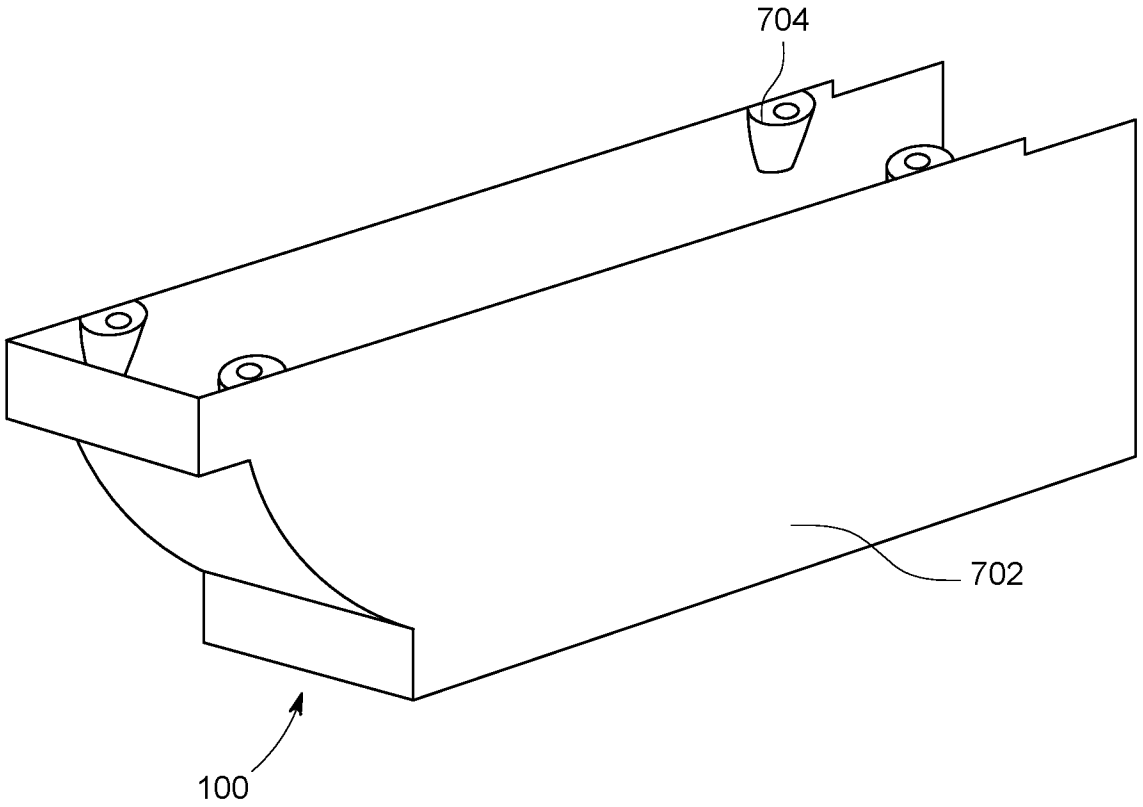
Figure 8:
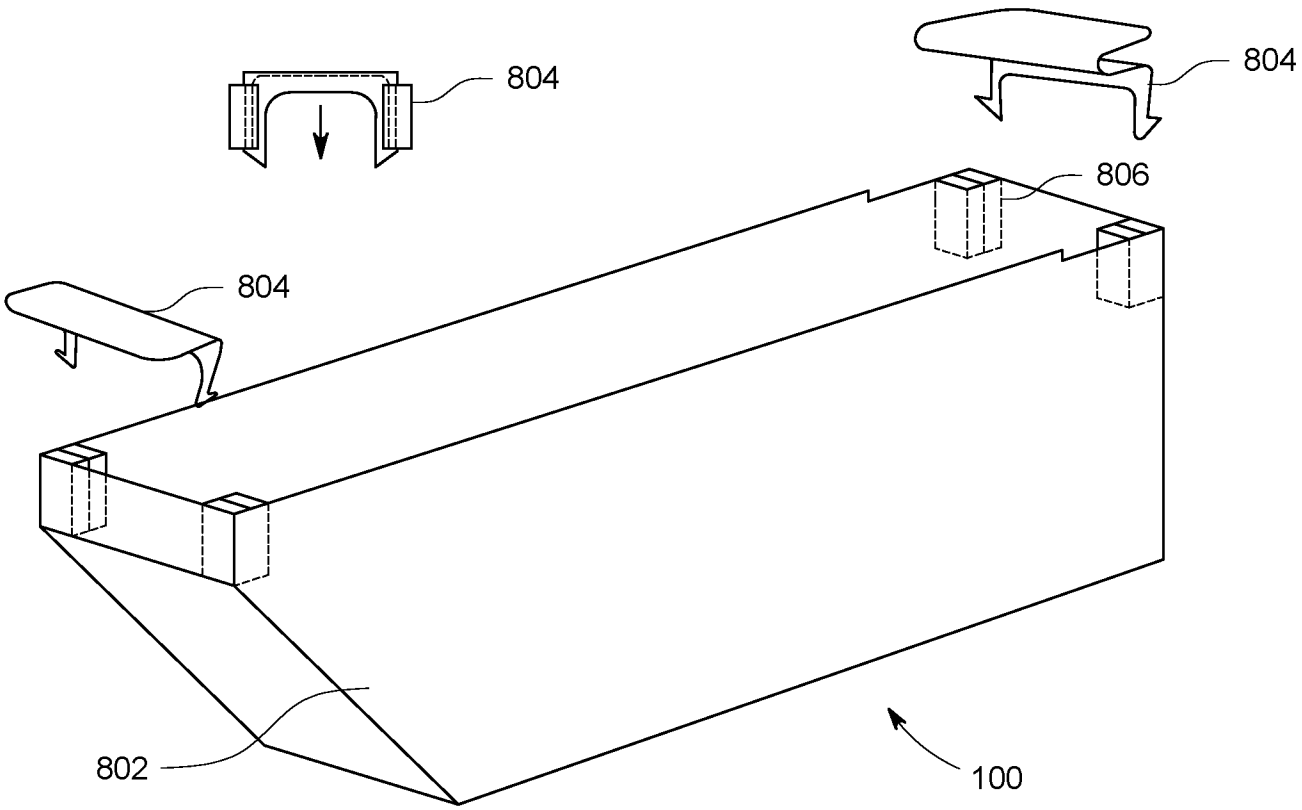
Figure 9:
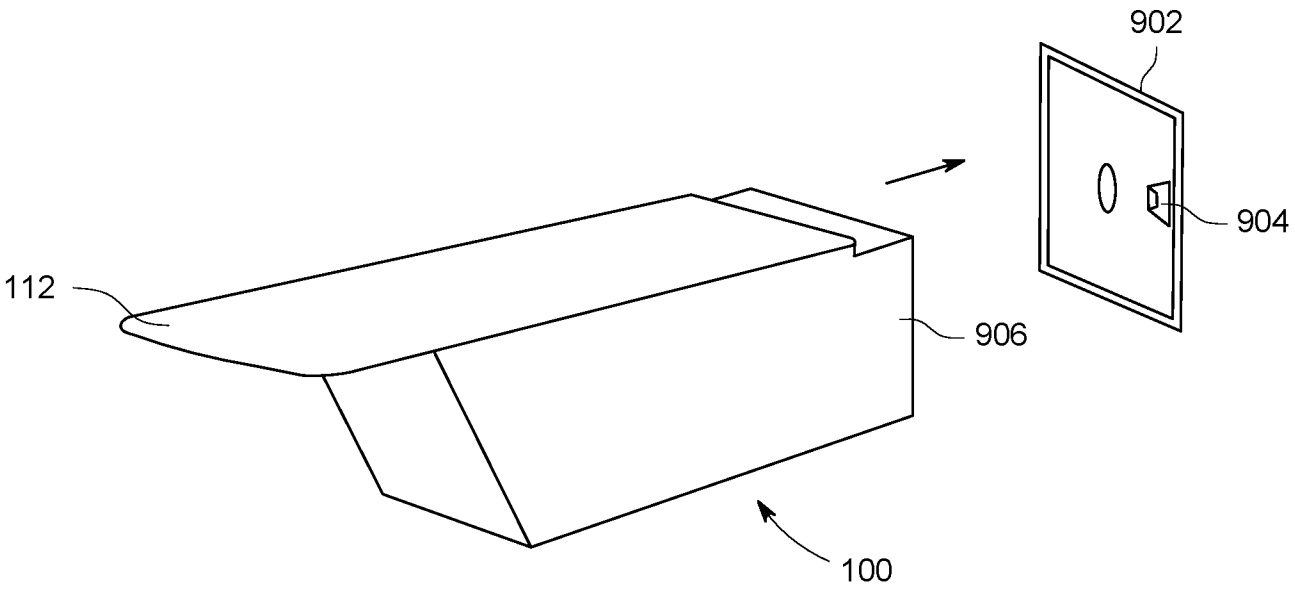
Figure 10A:
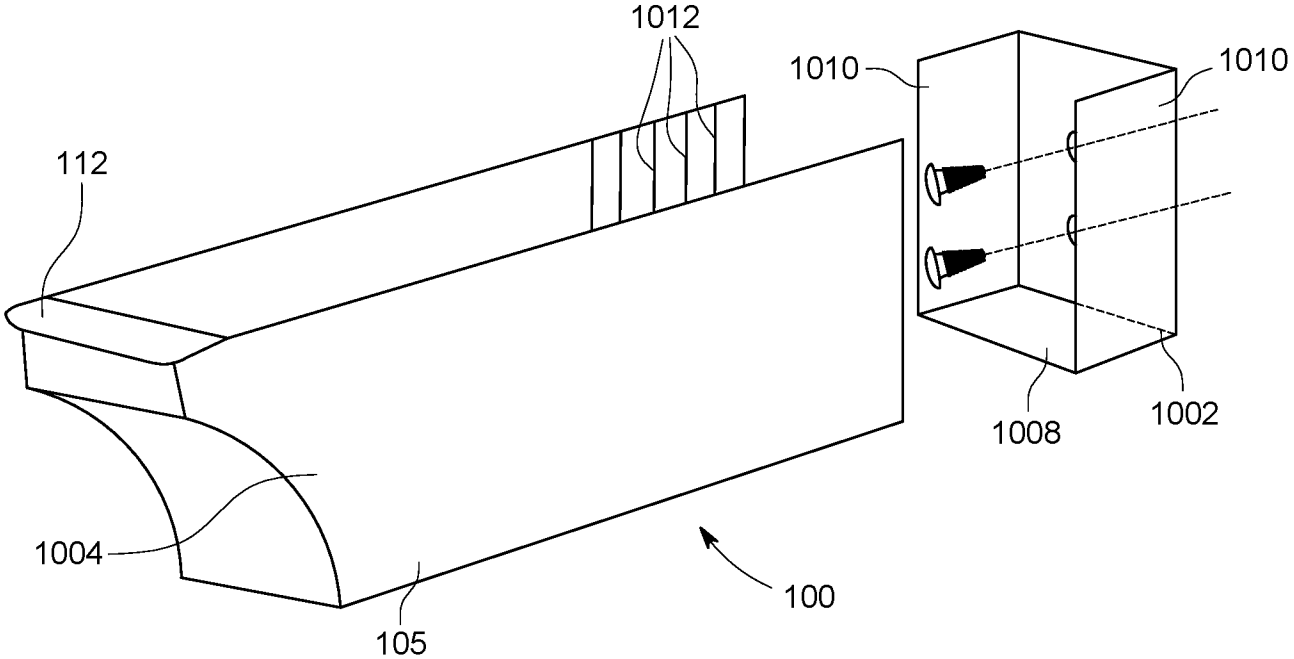
Figure 10B:
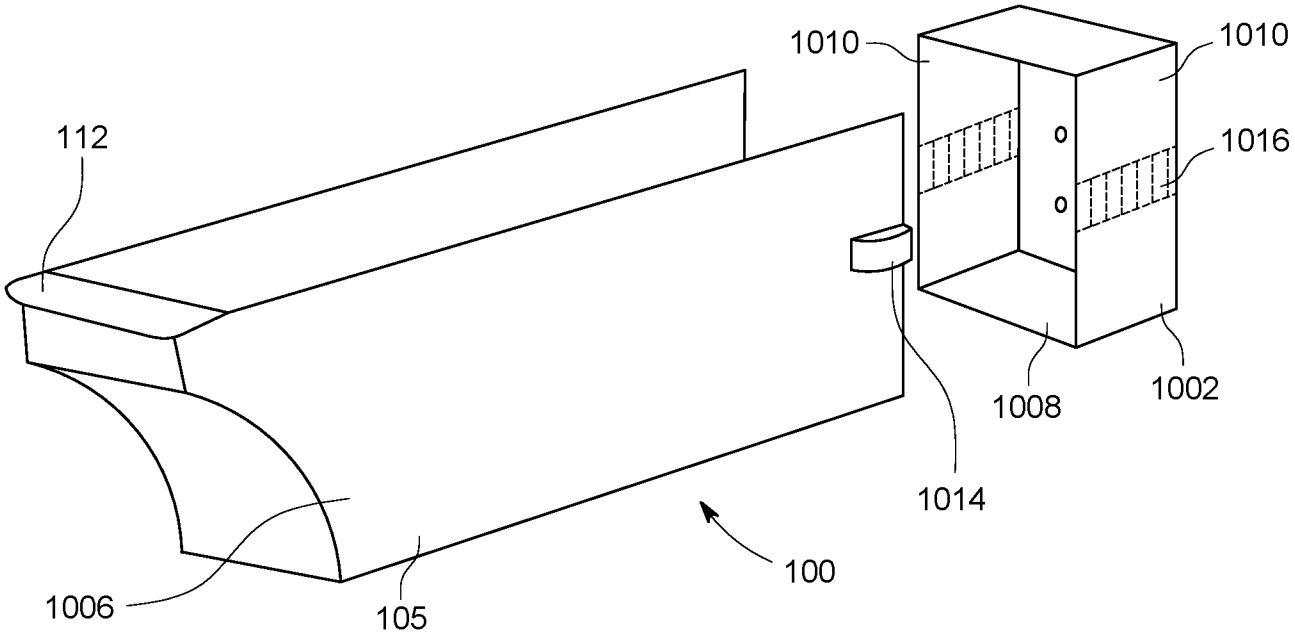
Figure 11:
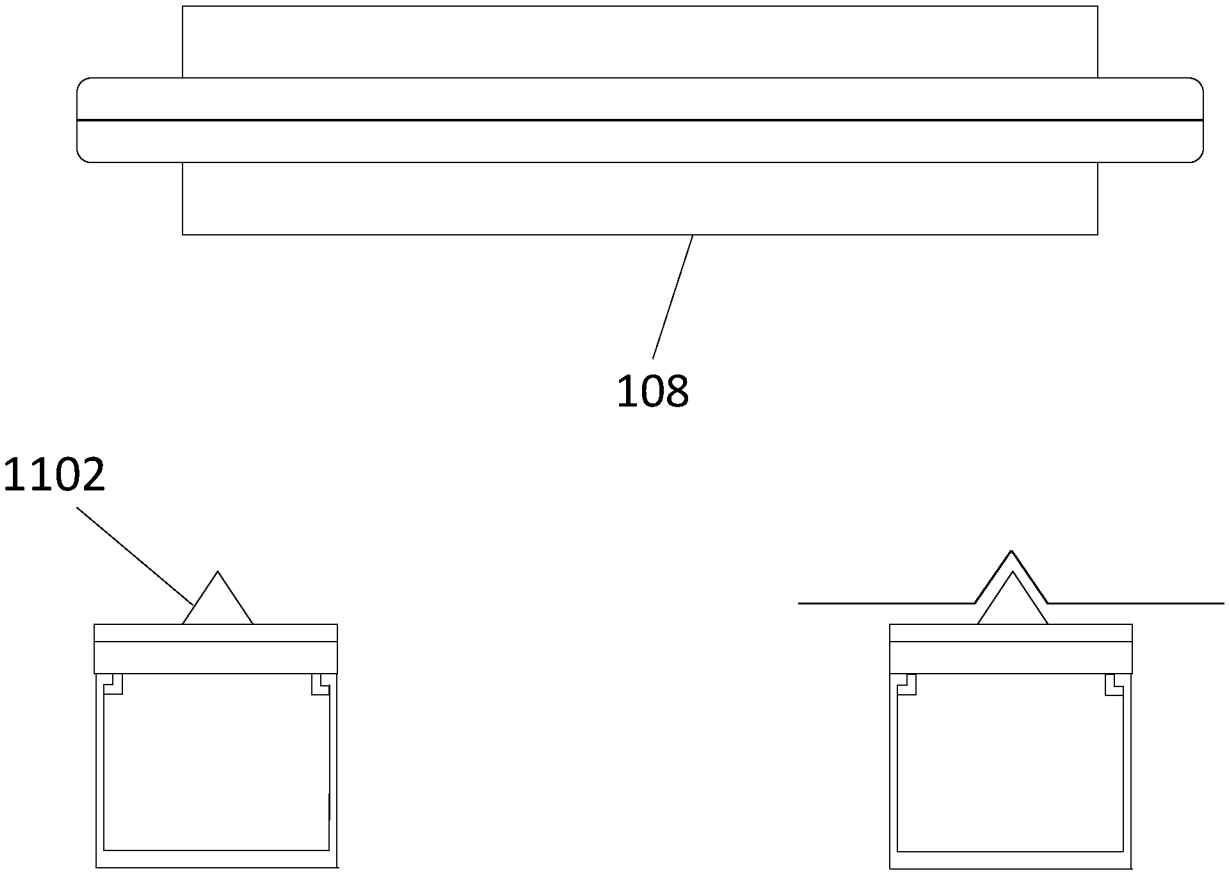
Figure 12:
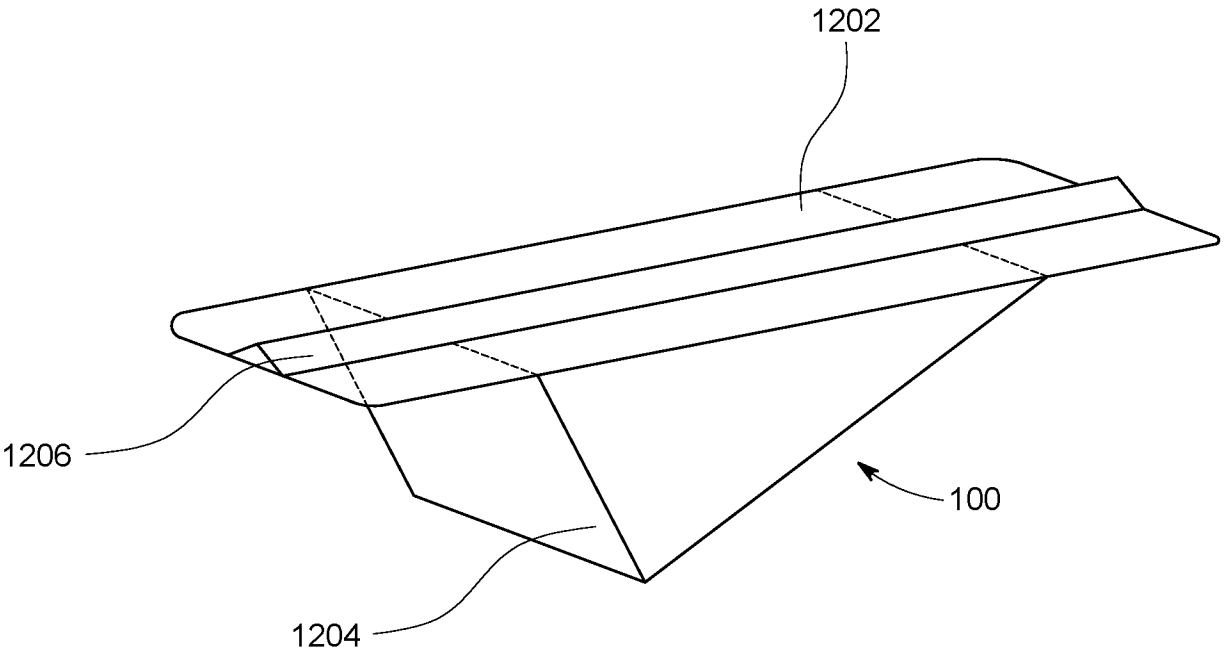
Figure 13:
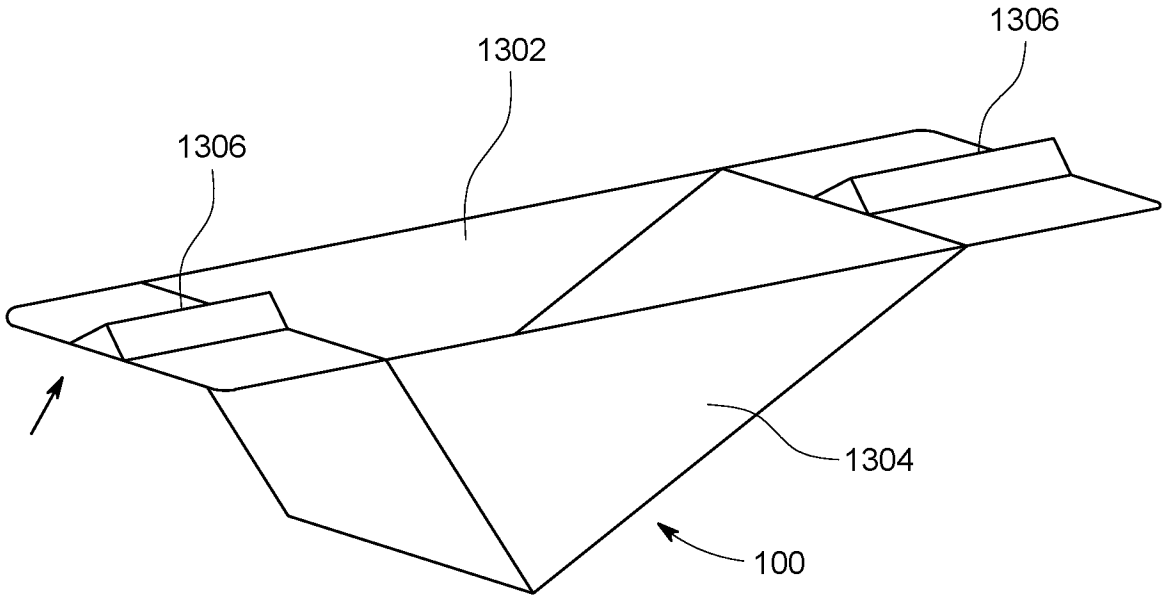
Figure 14:
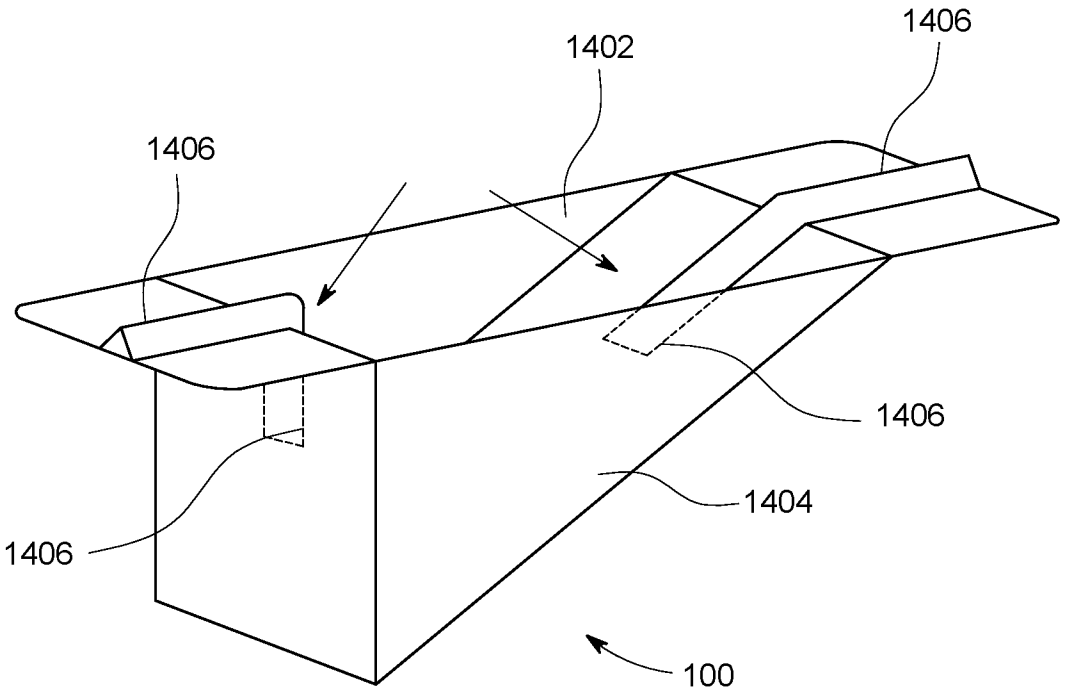
Figure 15:
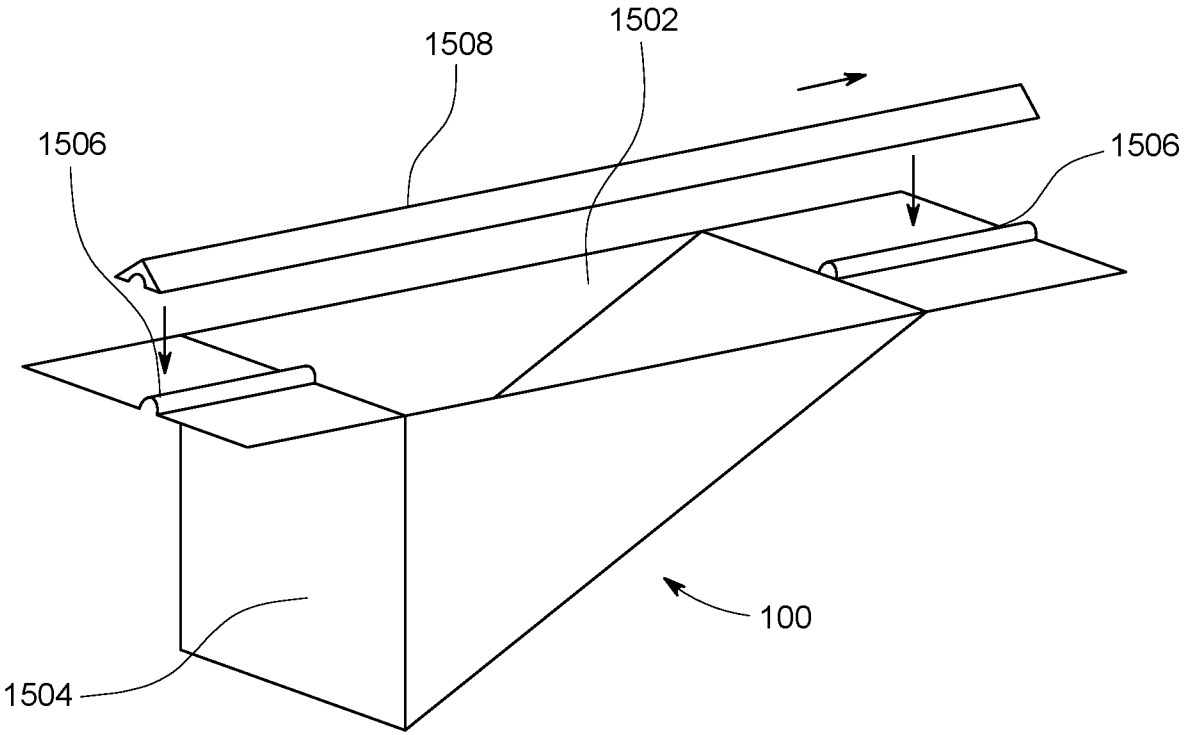
Figure 16:
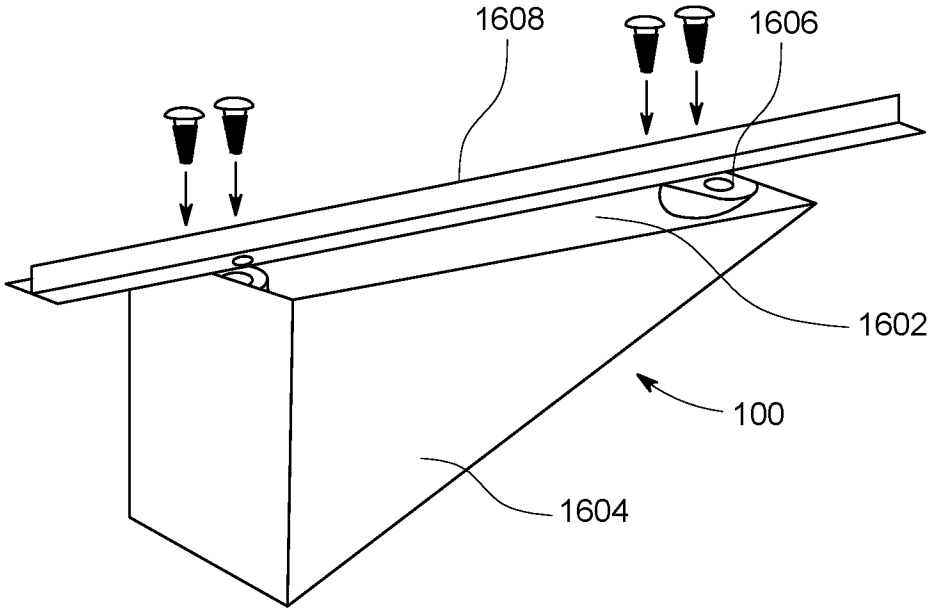
Figure 17:
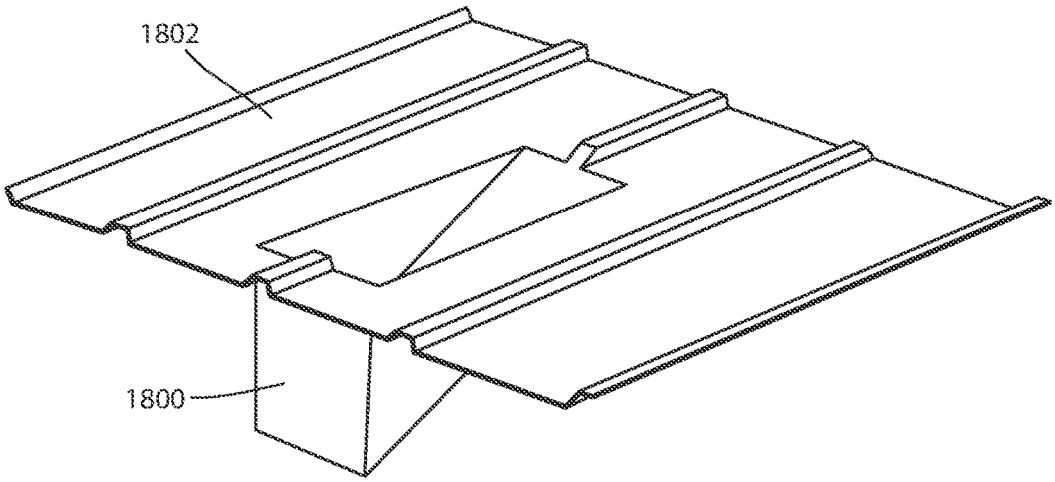
Figure 18:
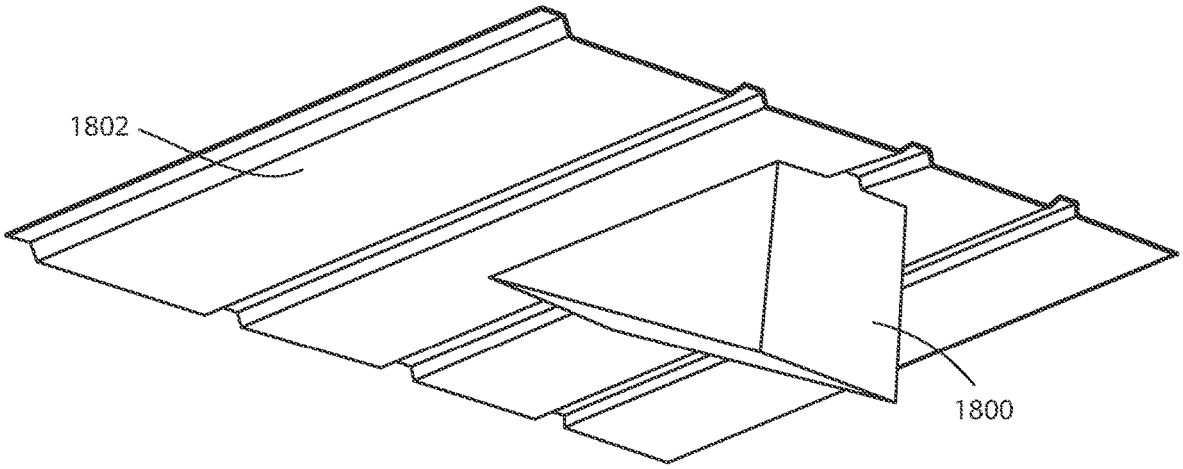
Figure 19:
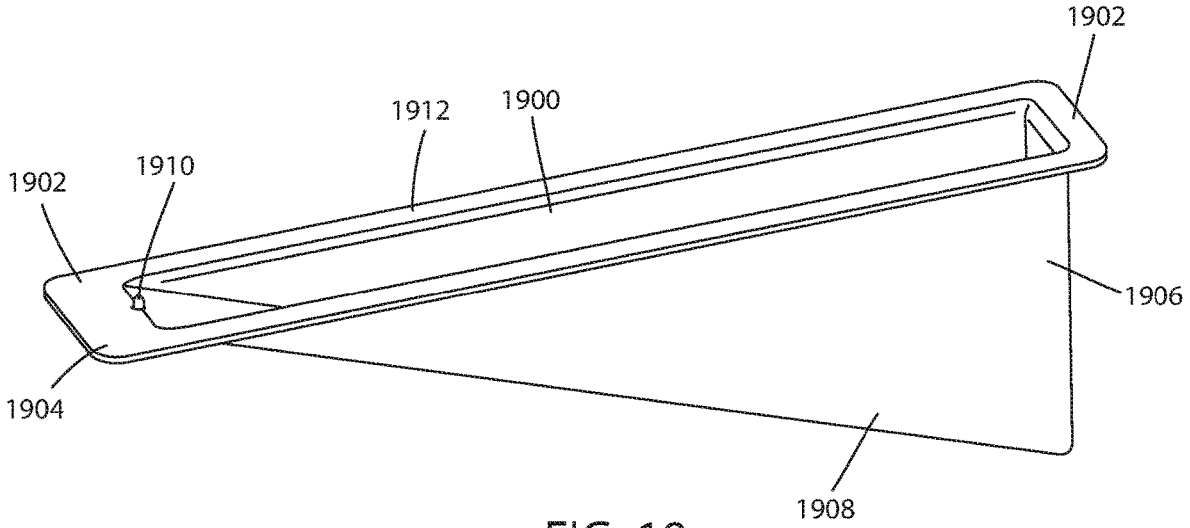
Figure 20:
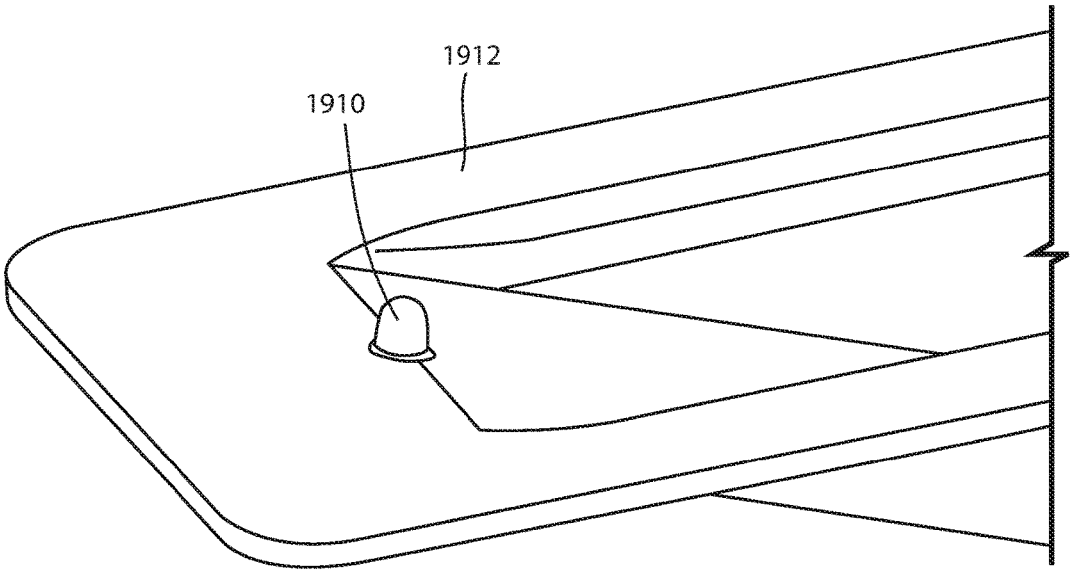
Figure 21:
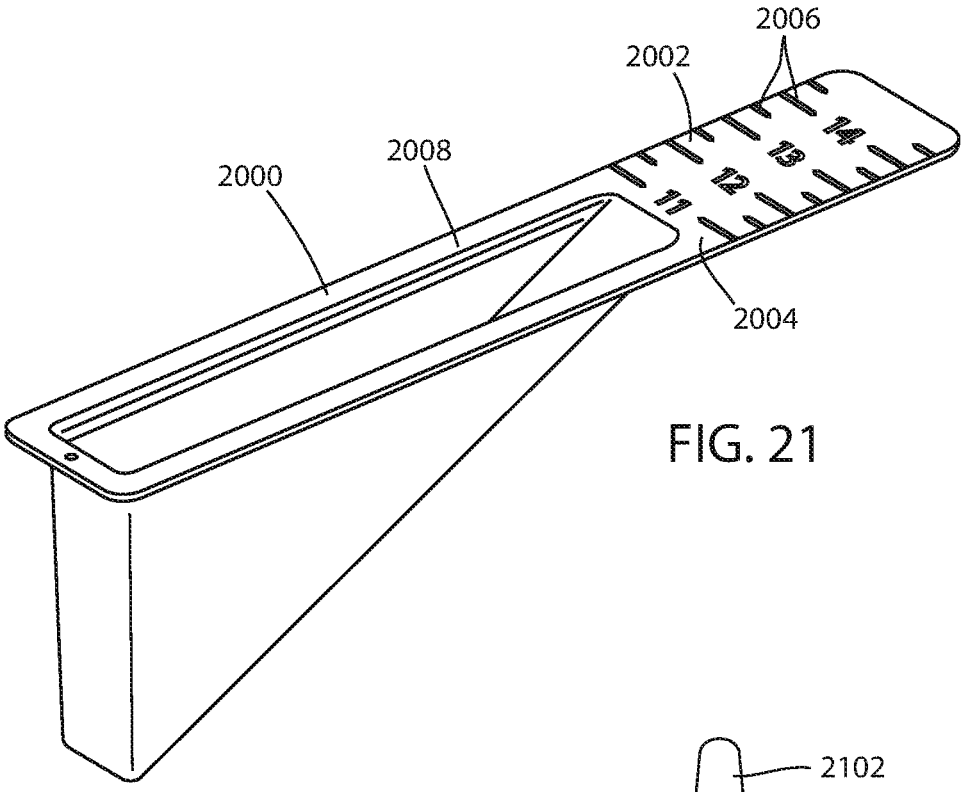
Figure 22:
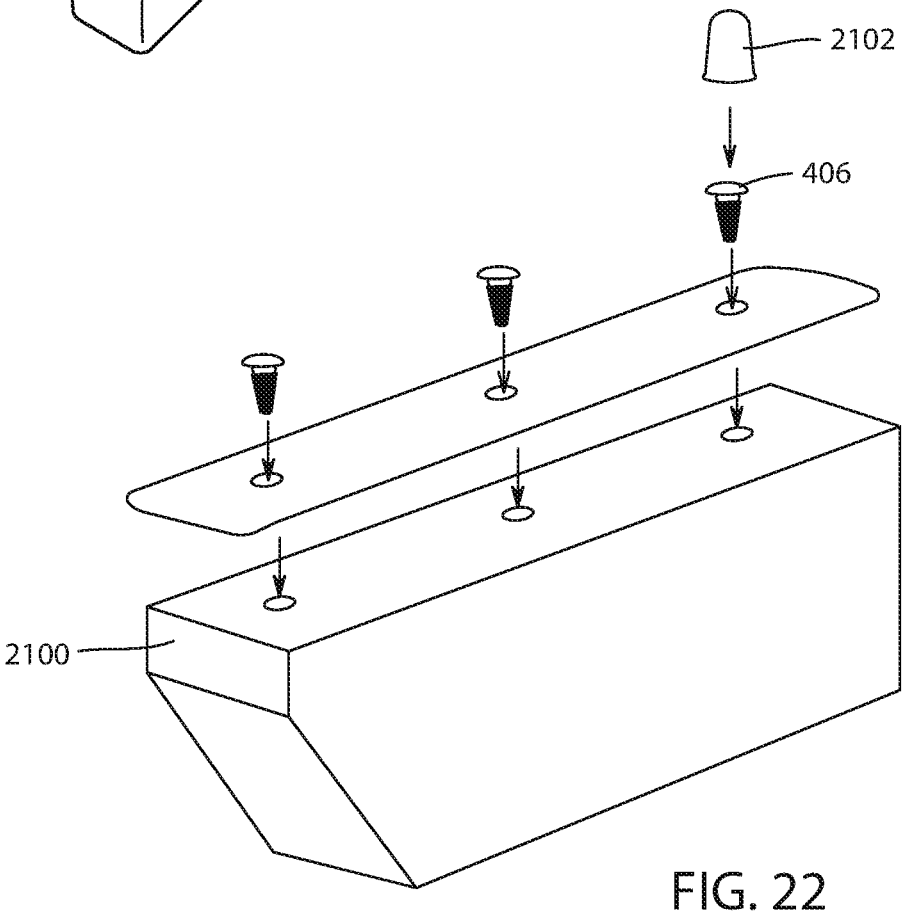
Figure 23:
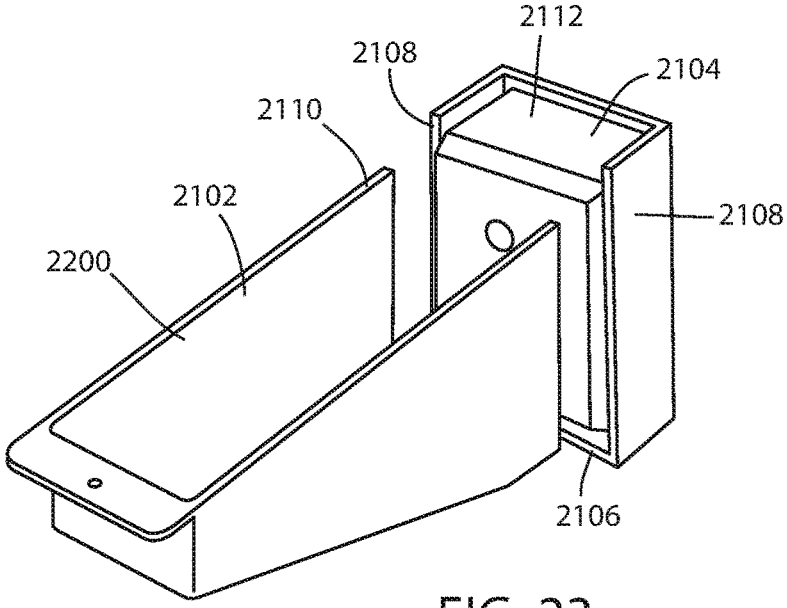
Figure 24C:
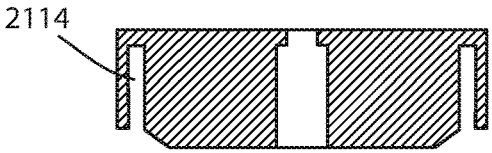
Figure 24A:
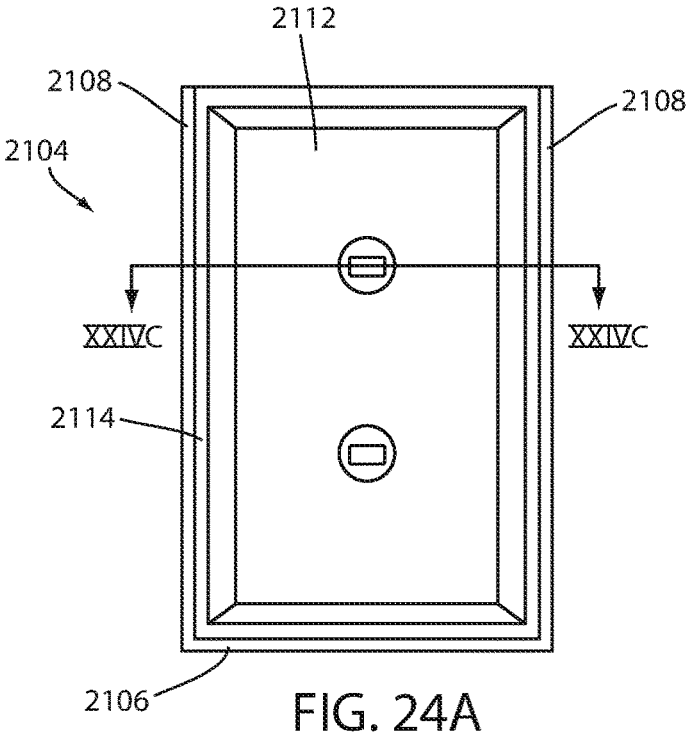
Figure 24B:
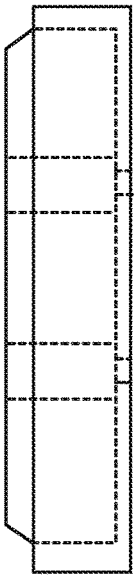
Figure 25:
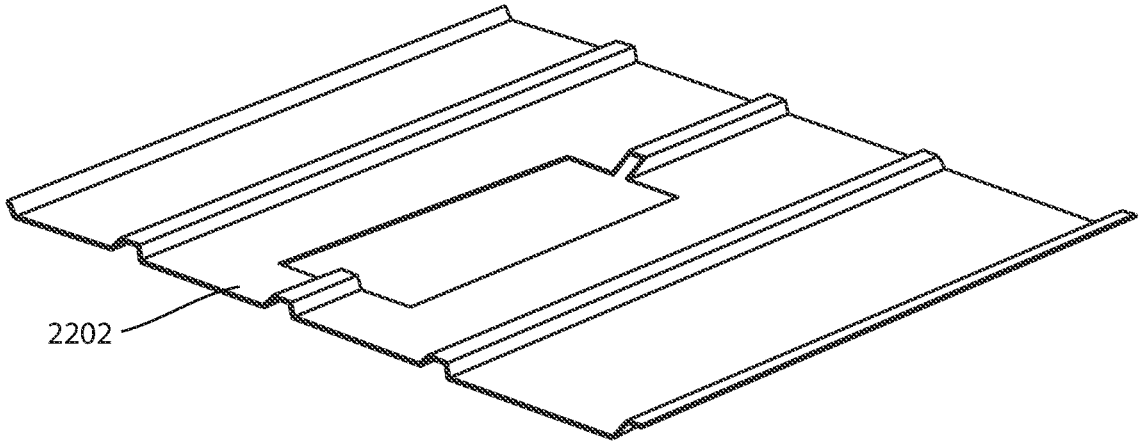

Having thus described example embodiments of the invention in general terms, reference will now be made to the accompanying drawings, which are not necessarily drawn to scale, and wherein:

FIG. 1A, FIG. 1B, and FIG. 1C illustrate various views of an exemplary faux rafter tail with a plurality of mounting tabs, in accordance with one or more exemplary embodiments;

FIG. 2A and FIG. 2B illustrate sectional views of an exemplary two-piece faux rafter tail, in accordance with one or more exemplary embodiments;

FIG. 3 illustrates a schematic view of an exemplary faux rafter tail which is attachable to an existing soffit, in accordance with one or more exemplary embodiments;

FIG. 4 illustrates an exemplary faux rafter tail having a flat top portion, a bottom portion, and one or more screws, in accordance with one or more exemplary embodiments;

FIG. 5 illustrates an exemplary faux rafter tail having one or more retaining clips attached on the top portion, in accordance with one or more exemplary embodiments;

FIG. 6 illustrates an exemplary faux rafter tail having a plurality of individual mounting tabs attachable through one or more screws, in accordance with one or more exemplary embodiments;

FIG. 7 illustrates an exemplary faux rafter tail having a hollow portion, in accordance with one or more exemplary embodiments;

FIG. 8 illustrates an exemplary faux rafter tail with one or more brackets, in accordance with one or more exemplary embodiments;

FIG. 9 illustrates an exemplary faux rafter tail with a wall mounting plate, in accordance with one or more exemplary embodiments;

FIG. 10A illustrates an exemplary faux rafter tail with another wall mounting plate, in accordance with one or more exemplary embodiments;

FIG. 10B illustrates an exemplary faux rafter tail with a squeezable body portion and one or more outward-extending tabs in accordance with one or more exemplary embodiments;

FIG. 11 illustrates an exemplary faux rafter tail with a triangular peak, in accordance with one or more exemplary embodiments;

FIG. 12 illustrates an exemplary faux rafter tail having a single ridge, in accordance with one or more exemplary embodiments;

FIG. 13 illustrates an exemplary faux rafter tail having one or more ridges, in accordance with one or more exemplary embodiments;

FIG. 14 illustrates an exemplary faux rafter tail having a plurality of ridges extending into the hollow section, in accordance with one or more exemplary embodiments;

FIG. 15 illustrates an exemplary faux rafter tail having one or more ridges and a vertical strength bar, in accordance with one or more exemplary embodiments;

FIG. 16 illustrates an exemplary faux rafter tail having a vertical strength bar and one or more holes on the corners, in accordance with one or more exemplary embodiments;

FIG. 17 illustrates a top perspective view of an exemplary faux rafter tail being integrally formed with a soffit;

FIG. 18 illustrates a bottom perspective view of an exemplary faux rafter tail being integrally formed with a soffit;

FIG. 19 illustrates an exemplary faux rafter tail having a hollow body and an alignment nub for retaining the faux rafter tail in position against a soffit;

FIG. 20 illustrates an enlarged view of the alignment nub in FIG. 19;

FIG. 21 illustrates an exemplary faux rafter tail having a hollow body and a mounting tab indexed with measurement indicators;

FIG. 22 illustrates an exemplary faux rafter tail having an alignment nub securable atop a screw head;

FIG. 23 illustrates an exemplary faux rafter tail with another wall mounting plate, in accordance with one or more exemplary embodiments;

FIG. 24A illustrates a front view of the wall mounting plate shown in FIG. 23;

FIG. 24B illustrates a side view of the wall mounting plate shown in FIG. 23;

FIG. 24C illustrates a sectional view of the wall mounting plate shown in FIG. 24A taken along line XXIVC;

FIG. 25 illustrates a soffit having a cutout; and

Figure 26:
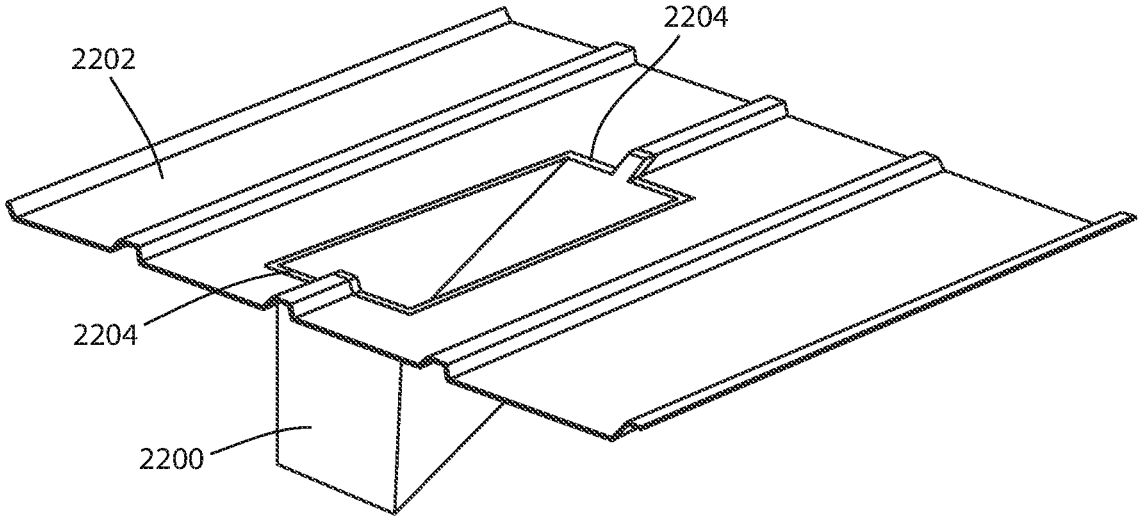

FIG. 26 illustrates an exemplary faux rafter tail, such as the one shown in FIG. 19, positioned within the cutout of the soffit shown in FIG. 25.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

The invention discloses a faux ornamental architectural component. Preferably, although not necessarily, the architectural component is a faux rafter tail. However, the invention can pertain to any suitable type of faux ornamental architectural component which is installed to the exterior of the building below a soffit and/or adjacent to the building's exterior wall, including but not limited to, a corbel, a dentil, any type of decorative under-eave support bracket, and so forth. The faux rafter tail may be securable below a soffit. The faux rafter tail comprises an elongated structure which includes a middle section and terminates in a proximal end and a distal end. In some example embodiments, the faux rafter tail may include a body portion and a top portion. The top portion may include a mounting tab at each of the proximal and distal ends, and each of the mounting tabs extends in a direction away from the middle section of the faux rafter tail. Each of the mounting tabs has a lower surface and an upper surface. In some example embodiments, the faux rafter tail may not require any additional anchoring apparatus when secured below the existing soffit. The built-in tabs or attachments that may be present in the faux rafter tail secures to the mounting channels for securing the soffit.

FIG. 1A, FIG. 1B, and FIG. 1C illustrate various views of an exemplary faux rafter tail 100 with a plurality of mounting tabs 102, in accordance with one or more exemplary embodiments. In some example embodiment, the faux rafter tail 100 may comprise an elongated structure which includes a middle section 101 and terminates in a proximal end 103 and a distal end 105. In some example embodiments, the faux rafter tail 100 may include a body portion 106 and a top portion 108. The top portion 108 may include a mounting tab 102 at each of the proximal and distal ends, 103 and 105, each of the mounting tabs 102 extending in a direction away from the middle section 101 of the faux rafter tail 100, and each of the mounting tabs 102 has a lower surface 110 and an upper surface 112.

As mentioned above, the ends of the soffit are retained in a channel which can generally have a cross-sectional profile of an "F" or "L." The soffit is retained in place by the channel. As will be described in greater detail below, the mounting tabs 102 of the faux rafter tail 100 are also retained in the channels to hold the faux rafter tail 100 in place.

In an example embodiment of the invention, the top portion 108 of the faux rafter tail 100 includes one or more mounting tabs 102. The one or more mounting tabs 102 may extend towards the channel to be secured below the soffit. In some example embodiments, the one or more mounting tabs 102 of the faux rafter tail 100 may be secured into the channel, and the bottom portion 106 of the faux rafter tail 100 is then secured to the top portion 108. Thus, the mounting tabs 102 bridge the faux rafter tail 100 between the channels.

When the faux rafter tail 100 includes a top portion 108 that is separate from, and securable to, the bottom portion 106, then suitable means for securing together the top portion 108 and the bottom portion 106 are provided. For example, the means for securing the top portion 108 and the bottom portion 106 together can include complementary frictionally fitting pieces, a clip-retaining system, brackets, fasteners, adhesives, or any other suitable means.

FIG. 2A and FIG. 2B illustrate an exemplary two-piece faux rafter tail, in accordance with one or more exemplary embodiments. In accordance with this embodiment, the faux rafter tail 100 may comprise two halves 202, 204 that are divided along the elongated length of the faux rafter tail 100, whereby each half is substantially a mirror image of the other half. In this regard, each half, 202, 204, can be secured into the soffit-retaining channel by being twisted into place within the channel. The two halves are then secured to one another. It is to be appreciated that ordinarily the width of the mounting tabs 112 may be too wide to be twisted into the channels, and therefore this problem is overcome by providing the separate halves in which case each half has mounting tabs 112 that are only half as wide, and therefore can be twisted into the channel.

FIG. 3 illustrates a schematic view of the faux rafter tail 100 which is attachable to the soffit-retaining channel 303. The soffit-retaining channel 303 shown in FIG. 3 would be considered an "L" channel. However, it would be considered an "F" channel if there was an additional outwardly-extending portion above the mounting tabs 112 and the soffit 302. In some embodiments, the length of the faux rafter tail 100 may be customized to fit the distance between the soffit-retaining channels 303.

FIG. 4 illustrates an exemplary faux rafter tail having a flat top portion 402, a bottom portion 404, and one or more fasteners 406, in accordance with one or more exemplary embodiments. In some example embodiments, the faux rafter tail 100 may comprise a flat top portion 402 and a bottom portion 404. In some example embodiments, the flat top portion 402 may be a flat planar plate terminating in the mounting tabs 112 at each end thereof, and the top portion 402 is secured at top the bottom portion 404 using any suitable means, such as fasteners 406.

In some example embodiments, the flat top portion 402 may comprise a plate which includes a plurality of holes through which one more fasteners 406 are inserted. Similarly, the bottom portion 404 may comprise one or more complementary holes, depending on the number and position of screws 406 of the top portion 402. In some example embodiments, the top plate is screwed into the top of the bottom portion 404.

FIG. 5 illustrates an exemplary faux rafter tail having one or more retaining clips 506 attached on the top portion 502, in accordance with one or more exemplary embodiments. In some example embodiments, the faux rafter tail 100 may comprise a top portion 502 and a bottom portion 504. The underside of the top portion 502 may comprise a plurality of retaining clips 506 to secure the top portion 502 to the bottom portion 504. For example, the retaining clips 506 can be snapped into the top of the bottom portion 504, or be held in place via tension strips (not shown).

FIG. 6 illustrates an exemplary faux rafter tail 100 having a plurality of individual mounting tabs 602 attachable through one or more fasteners 606, in accordance with one or more exemplary embodiments. In some example embodiments, the faux rafter tail 100 may comprise a plurality of individual mounting tabs 602 and a hollow rectangular bottom portion 604. The plurality of individual mounting tabs 602 can include a plurality of holes through which one more fasteners 606 may be inserted. Similarly, the bottom portion 604 comprises one or more holes on one or more corners depending on the number of fasteners 606 of the plurality individual of mounting tabs 602. In some example embodiments, the plurality of individual mounting tabs 602 may be screwed into the top of the bottom portion 604.

FIG. 7 illustrates an exemplary faux rafter tail 100 having a hollow portion 702 according to example embodiments of the present invention. In some example embodiments, the faux rafter tail 100 may comprise a hollow section 702. The hollow section 702 may comprise a concave portion at one end. The hollow section 702 may comprise one or more holes 704 on the one or more corners.

FIG. 8 illustrates an exemplary faux rafter tail 100 with one or more brackets 804, according to example embodiments of the present invention. In some example embodiments, the faux rafter tail 100 may comprise a hollow portion 802. One or more brackets 804 may be attached to the one or more corners 806 of the hollow portion 802 via spring action. In some example embodiments, the hollow portion 804 may have a hollow section. In some example embodiments, the brackets 804 may include a front bracket and a back bracket.

FIG. 9 illustrates an exemplary faux rafter tail 100 with a mounting plate 902, according to example embodiments of the present invention. In some example embodiments, the faux rafter tail 100 may comprise a mounting plate 902 that may include a locking mechanism 904. The mounting plate 902 may be mounted on the wall of the building using a fastener, adhesive, or other suitable means (not shown). In some example embodiments, the faux rafter tail 100 may comprise a body 906, and one end of the body 906 is secured to the mounting plate 902 via the locking mechanism 904. The other end of the base 902 may be connected to the soffit channel via a mounting tab 112. In some example embodiments, the length of the rafter tail 100 may be cut to adjust the width of the soffit.

FIG. 10A illustrates an exemplary faux rafter tail 100 having a non-planar hollow body 1004, in accordance with one or more exemplary embodiments. In some example embodiments, the faux rafter tail 100 may comprise a mounting plate 1002 that is secured to the wall of the building. The mounting plate 1002 has a lower wall 1008 and opposed side walls 1010, and the lower wall 1008 and side walls 1010 form a receptacle for receiving the body portion 1004. The distal end 105 of the body 1004 is connected to the soffit-retaining channel via the mounting tab 112.

In some example embodiments, the length of the rafter tail 100 may be cut to adjust to the width of the soffit. For example, the rafter tail 100 can include measured index lines 1012 as designated cutting lines, as shown in FIG. 10A. And as shown throughout various drawings, the body 1004 may optionally comprise a non-planar hollow structure. In some example embodiments, the body 1004 may be slidable into the mounting plate 1002.

FIG. 10B illustrates an exemplary faux rafter tail 100 having a squeezable body portion 1006 and one or more outward-extending tabs 1014, in accordance with one or more exemplary embodiments. In some example embodiments, the faux rafter tail 100 may comprise a mounting plate 1002 that is securable to the wall of the building. The mounting plate 1002 has a lower wall 1008 and opposed side walls 1010. The lower wall 1008 and side walls 1010 form a receptacle for receiving the body portion 1006. The distal end 105 of the body 1006 is connected to the soffit-retaining channel via the mounting tab 112.

In some example embodiments, the body portion 1006 may be open or closed at the top. In some example embodiments, the mounting plate 1002 may comprise one or more slots 1016 on each side of the opposed side walls 1010. In some example embodiments, the body portion 1006 may comprise one or more outward-extending tabs 1014 on each side, which may fit into the one or more slots 1016 in the mounting plate 1002. In some example embodiments, the side walls of the body portion 1006 may be squeezed together so that the body portion 1006 can be inserted or slid into the receptacle of the mounting plate 1002, and outward-extending tabs 1014 are positioned within the desired slots 1016 of the mounting plate 1002, depending on the desired length of the body portion 1006.

In some example embodiments, the height of the mounting plate 1002 may be substantially same as the height of the body portion 1004. In an alternative embodiment, the base 1008 of the mounting plate 1002 and the base of the body portion 1006 may have substantially same size. In some example embodiments, there may be multiple sets of the one or more outward-extending tabs 1014 as well as the one more slots 1016.

FIG. 11 illustrates an exemplary faux rafter tail 100 with a triangular peak 1102 according to example embodiments of the present invention. In some example embodiments, the faux rafter tail 100 may comprise a triangular peak 1102 running down the center of the top of the top portion 108. In some example embodiments, the triangular peak 1102 limits any side-to-side movement of the rafter. Many modern plastic sheet soffits include "V"-shaped grooves extending between the soffit-retaining channels. In this regard, the triangular peak 1102 is complementary with the "V"-shaped grooves in the soffit and the triangular peak 1102 engages within the groove to eliminate side-to-side movement of the faux rafter tail 100.

FIG. 12 illustrates an exemplary faux rafter tail 100 having a single ridge 1206, according to example embodiments of the present invention. In some example embodiments, the rafter tail 100 may comprise a top portion 1202 and a bottom portion 1204. The top portion 1202 may include a ridge 1206 which extends the entire length of the top portion 1202.

In some example embodiments, the bottom portion 1204 may have a triangular peak that is attached on the top portion 1202. In some example embodiments, the faux rafter tail 100 may be one-piece molded plastic with a top portion 1202 and a bottom portion 1204.

In addition, and as shown throughout FIGS. 12-17, the body portion 106 of the faux rafter tail 100 can be angled, or generally triangular in cross-section. In this regard, the angled body portion 106 has a bottom planar surface which is generally parallel with, and follows the angle of the roof line so as to more accurately have the full rafter tail 100 mimic the appearance and orientation of an exposed true rafter tail.

FIG. 13 illustrates an exemplary faux rafter tail having one or more ridges 1306, in accordance with one or more exemplary embodiments. In some example embodiments, the faux rafter tail 100 may comprise a top portion 1302 which may have a hollow section in the middle portion whereby a bottom portion 1304 may run along length of the hollow portion. In some example embodiments, the top portion 1302 may include one or more ridges 1306 on each side which may fit into the "V"-shaped grooves of the soffit. In some example embodiments, the one or more ridges 1304 which may be present on each side of the top portion 1302 may prevent any unwanted movement, when the faux rafter tail 100 is connected below the soffit.

FIG. 14 illustrates an exemplary faux rafter tail having a plurality of ridges running on the hollow section, in accordance with one or more exemplary embodiments. In some example embodiments, the faux rafter tail 100 may comprise a top portion 1402 which may have a hollow section in the middle whereby a bottom portion 1404 having a triangular peak is running Thus, the triangular peak may comprise a hollow section. In the exemplary embodiment, the triangular peak may not run in equal lengths of the base. In some example embodiments, the top portion 1402 may include one or more ridges 1406 on each side which may fit into the "V"-shaped grooves of the soffit. In some example embodiments, the one or more ridges 1406 extend into the hollow section. The one or more ridges 1406 may be present on each side of the top portion 1402 that prevents any unwanted movement when the faux rafter tail 100 is connected to the soffit.

FIG. 15 illustrates an exemplary faux rafter tail having one or more ridges 1606 and a vertical strength bar 1608, in accordance with one or more exemplary embodiments. In some example embodiments, the faux rafter tail 100 may comprises a top portion 1602 which may have a hollow section in the middle portion whereby a triangular peak of a bottom portion 1604 is running in the hollow section. Thus, the triangular peak of the top portion 1602 of may comprise a hollow section. The triangular peak extends the length of the top portion 1602. In some example embodiments, the top portion 1602 may include one or more ridges 1606 on each side which may fit into the soffit-retaining channels.

The strength bar 1608 prevents any unwanted movement when the faux rafter tail 100 is connected to the soffit, and also extends the entire length of the faux rafter tail 100 to add additional rigidity and strength thereto. The vertical strength bar 1608 may be configured to fit on the one or more ridges 1606 of the top portion 1608.

FIG. 16 illustrates an exemplary faux rafter tail having a vertical strength bar 1708 and one or more holes 1706 on the corners, in accordance with one or more exemplary embodiments. In some example embodiments, the faux rafter tail 100 may comprise a top portion 1702 which may have a hollow section in the middle portion whereby a triangular peak 1704 is running in the top portion 1702. Thus, the top portion 1702 may comprise a hollow section. The top portion 1702 may comprise one more holes 1706. In some example embodiment, the faux rafter tail 100 may include a vertical strength bar 1708 to snap into the soffit. As shown, the strength bar 1708 has a "T"-shaped cross-section to allow for engagement into the "V"-shaped groove in the soffit, and also to permit or placement of through holes so that fasteners can be used to secure the strength bar 1708 to the faux rafter tail 100.

FIGS. 17 and 18 illustrate yet another exemplary embodiment, in which a faux rafter tail 1800 is integrally formed with a soffit 1802. According to this embodiment, the soffit 1802 and the faux rafter tail 1800 are integrally formed together, such that they are formed from a single piece of material. The faux rafter tail 1800 and the soffit 1802 can be manufactured using any suitable technique. As shown in FIG. 17, the faux rafter tail 1800 is preferably hollow, although not necessarily. The faux rafter till 1800 can be formed from a solid piece of material, but it may be advantageous to make the faux rafter tail 1800 hollow for purposes of manufacturing, material cost reduction, for shipping purposes (such that the pieces may be nested one into another for shipping and packaging), and so forth.

Preferably, the faux rafter tail 1800 and the soffit 1802 comprise a plastic material and are manufactured using any suitable well-known technique for making such a component, such as injection molding, vacuum molding, or the like. The faux rafter tail 1800 and the soffit 1802 can also be formed from any other suitable types of material which are conducive to manufacturing, such as aluminum. Although the faux rafter tail 1800 shown in FIGS. 17 and 18 has a triangular side profile to emulate a rafter tail extending downwardly along the roofline of a house, the faux rafter tail 1800 can also have a rectangular side profile similar to other faux rafter tails shown hereinabove.

FIGS. 19 and 20 illustrate an exemplary faux rafter tail 1900 having a plurality of mounting tabs 1902 secured to the proximal end 1904 and the distal end 1906. According to this embodiment, the mounting tabs 1902 are preferably integrally formed with the faux rafter tail 1900. Furthermore, the faux rafter tail 1900 preferably has a hollow bottom portion 1908. In addition, the faux rafter tail 1900 additionally includes an alignment nub 1910 extending upwardly from a top portion 1912 of the faux rafter tail 1900. The alignment nub 1910 is an extension or protuberance extending upwardly toward the soffit when the faux rafter tail 1900 is installed onto the soffit. In the drawings, the alignment nub 1910 is shown positioned near a base of the mounting tab 1902 on the proximal end 1904, although the alignment of 1910 could alternatively be positioned near a base of the mounting tab 1902 on the distal end 1906, or at any other suitable location on the top portion 1912. Furthermore, multiple alignment knobs 1910 could be provided if desired. Similar to the triangular peak 1102 described in another embodiment above, the alignment nub 1910 engages with, and is secured into, a groove or recess in the soffit. Retention of the alignment nub 1910 within the soffit groove restricts the faux rafter tail 1900 from twisting, rotating, or becoming otherwise misaligned after installation due to wind, impact from any objects, or any other forces which might position the faux rafter tail 1900 incorrectly over time. Preferably, the faux rafter tail 1900, as well as the mounting tabs 1902 and the alignment nub 1910, are integrally formed from a single piece of material. Even more preferably, the faux rafter tail 1900 is formed using any suitable manufacturing techniques, such as injection molding or vacuum molding. Furthermore, the faux rafter tail 1900 comprises any suitable material, such as metal, plastic, or composites thereof. FIG. 20 shows an enlarged view of the alignment nub 1910.

FIG. 21 illustrates an exemplary faux rafter tail 2000 which is similar to the embodiment shown in FIG. 19. The faux rafter tail 2000 may also optionally include an alignment nub 1910, although an alignment nub is not shown in FIG. 21. In addition, the faux rafter tail 2000 includes an extended mounting tab 2002 at the proximal end 2004 of the faux rafter tail 2000 which is longer than the mounting tab 2002 at the opposite end of the faux rafter tail 2000. The extended mounting tab 2002 includes, or is indexed with, measurement indicators 2006. The measurement indicators 2006 include a value, such as to indicate the length of the top portion 2008 of the faux rafter tail 2000. In this regard, the measurement indicators 2006 can be used during installation to assist the installer with modifying the length of the extended mounting tab 2002 to fit the particular application. For example, if a particular soffit is known to be 12 inches wide, then the installer can quickly and easily cut the extended mounting tabs 2002 on all of the faux rafter tails 2000 to a length of 12 inches as indicated by the measurement indicators 2006. The measurement indicators 2006 can be integrally formed into the mounting tab 2002, or alternatively it can be written, marked, or painted onto the mounting tab 2002.

FIG. 22 illustrates an exemplary faux rafter tail 2100 which is similar to that shown in FIG. 4. The faux rafter tail 2100 includes an alignment nub 2102 which is securable onto one of the fasteners 406. The alignment nub 2102 includes a recess at the bottom thereof (not shown) for receiving a head of the fastener 406. The alignment nub 2102 is preferably formed from a flexible yet resilient material, such as rubber or a polymer.

FIGS. 23-24C illustrate an exemplary faux rafter tail 2200 having a hollow body 2102, in accordance with one or more exemplary embodiments. In some example embodiments, the faux rafter tail 2200 may include a mounting plate 2104 that is secured to the wall of the building. The mounting plate 2104 has a lower wall 2106 and opposed side walls 2108, and the lower wall 2106 and side walls 2108 form a receptacle for receiving the hollow body 2102. The mounting plate 2104 additionally has a central portion 2112 which forms a U-shaped channel 2114 between the central portion 2112 and the lower wall 2106 and the side walls 2108. A proximate end 2110 of the hollow body 2102 is retained within the channel 2114 when installed onto a building. The depth of the channel 2114 provides an amount of adjustability as to the total length of the faux rafter tail 2200 and the mounting plate 2104. Furthermore, the faux rafter tail 2200 and the mounting plate 2104 can be oriented at an askew angle with respect to one another, such as when the mounting plate 2104 is mounted onto angled siding on the exterior of a building.

FIGS. 25 and 26 illustrate yet another exemplary embodiment, in which a faux rafter tail 2200 is positioned within, or suspended from, a soffit 2202. According to this embodiment, the soffit 2202 includes a cut out portion, and the faux rafter tail 2200 is inserted through the cut-out portion from above and is thus suspended downward. The cut-out portion and the faux rafter tail 2200 are dimensioned such that the mounting tabs 2204 on the faux rafter tail 2200 are wider than the cut out portion and function to suspend the faux rafter tail 2200 downwardly through the cut out portion.

The various faux rafter tails described herein may be formed from any suitable type of materials, such as plastic, metal, wood, hardened foam, composite materials, or the like. Furthermore, the faux rafter tails and associated components described herein may be manufactured using any suitable techniques, such as injection molding, extrusion, sheet metal forming, thermoforming, vacuum molding, and so forth.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An article of manufacture, comprising:

a faux rafter tail configured to be secured below a soffit, the faux rafter tail having a body section which is elongated, having a middle section, and terminating in a proximal end and a distal end;

the faux rafter tail including a top portion having a mounting tab at each of the proximal end and the distal end, each of the mounting tabs extending in a direction away from the middle section of the faux rafter tail, and each of the mounting tabs extending beyond the respective distal end and the proximal end, and each of the mounting tabs having a lower surface and an upper surface, and the top portion having at least one alignment nub which protrudes upward from the top portion, the alignment nub being configured for fitment within a groove in an adjacent soffit.

2. The article of manufacture of claim 1 wherein each mounting tab is secured to the top portion by a fastener.

3. The article of manufacture of claim 2 wherein the fastener is a threaded fastener.

4. The article of manufacture of claim 1 wherein the body portion is hollow.

5. The article of manufacture of claim 1, wherein the body portion has a bottom surface and the top portion has an upper surface, and the bottom surface is substantially parallel with an upper surface.

6. An article of manufacture, comprising:

a faux rafter tail configured to be secured below a soffit, the faux rafter tail having a body section which is elongated, having a middle section, and terminating in a proximal end and a distal end;

the faux rafter tail including a top portion having a mounting tab at each of the proximal end and the distal end, each of the mounting tabs extending in a direction away from the middle section of the faux rafter tail, and each of the mounting tabs extending beyond the respective distal end and the proximal end, and each of the mounting tabs having a lower surface and an upper surface, and the top portion having at least one ridge which protrudes upward from the top portion, the ridge being configured for fitment within a groove in an adjacent soffit.

7. The article of manufacture of claim 6 wherein each mounting tab is secured to the top portion by a fastener.

8. The article of manufacture of claim 7 wherein the fastener is a threaded fastener.

9. The article of manufacture of claim 6 wherein the body portion is hollow.

10. The article of manufacture of claim 6, wherein the body portion has a bottom surface and the top portion has an upper surface, and the bottom surface is substantially parallel with an upper surface.

* * * * *